US006354050B1

(12) United States Patent
Pankoski

(10) Patent No.: US 6,354,050 B1
(45) Date of Patent: Mar. 12, 2002

(54) FABRICATED FOUNDATION WALL

(75) Inventor: Steve Pankoski, Denver, CO (US)

(73) Assignee: Bounce, Inc., Golden, CO (US)

( * ) Notice: Subject to any disclaimer, the term of this patent is extended or adjusted under 35 U.S.C. 154(b) by 14 days.

(21) Appl. No.: 09/605,488

(22) Filed: Jun. 28, 2000

(51) Int. Cl.[7] ..... E02D 27/00; E04B 9/00

(52) U.S. Cl. ..... 52/293.3; 52/292; 52/364; 52/126.6

(58) Field of Search ..... 52/169.5, 169.11, 52/169.14, 294, 293.1, 127.11, 259, 299, 293.3, 302.3, 302.6, 579, 169.1

(56) References Cited

U.S. PATENT DOCUMENTS

| | | | | |
|---|---|---|---|---|
| 1,652,415 A | | 12/1927 | Schenker | |
| 1,764,001 A | | 6/1930 | Blanchard | |
| 2,078,969 A | * | 5/1937 | Patterson | 189/28 |
| 2,387,229 A | | 10/1945 | Auten | |
| 3,608,259 A | | 9/1971 | Iwens | |
| 3,789,559 A | | 2/1974 | Kirkes | |
| 3,879,905 A | | 4/1975 | Catalano, Sr. | |
| 4,107,889 A | * | 8/1978 | Gonsalves et al. | 52/259 |
| 4,263,762 A | * | 4/1981 | Reed | 52/293 |
| 4,462,193 A | | 7/1984 | Ericson | |
| 4,638,615 A | * | 1/1987 | Taylor | 52/364 |
| 4,738,061 A | | 4/1988 | Herndon | |
| 4,899,497 A | | 2/1990 | Madl, Jr. | |
| 4,918,891 A | * | 4/1990 | Gerszewski | 52/295 |
| 5,287,675 A | | 2/1994 | McGee | |
| 5,402,614 A | | 4/1995 | Jewell | |
| 5,870,866 A | | 2/1999 | Herndon | |
| 5,924,251 A | * | 7/1999 | Jalla | 52/293.1 |
| 6,076,320 A | * | 6/2000 | Butler | 52/294 |
| 6,094,873 A | * | 8/2000 | Hoffman et al. | 52/126.6 |

FOREIGN PATENT DOCUMENTS

| | | |
|---|---|---|
| AU | 221579 | 4/1959 |
| AU | 487332 | 1/1975 |
| GB | 797416 | 7/1958 |
| GB | 2016057 A | 9/1979 |

* cited by examiner

*Primary Examiner*—Carl D. Friedman
*Assistant Examiner*—Basil Katcheves
(74) *Attorney, Agent, or Firm*—Sheridan Ross P.C.

(57) ABSTRACT

A fabricated foundation wall is constructed in soil below grade level and has three major components. The first is a basement wall grid which includes a lower beam mounted on spaced piers. A plurality of vertical support members are spaced along and extend upwardly from the lower beam. An identical upper beam spans and is attached to upper ends of the vertical support members. The second component is an outer wall structure which attaches to and extends across the outer surface of the basement wall grid and extends below the lower beam to form an air void. The third component is an inner wall structure which includes lower and upper tracks attached to the lower and upper beams, respectively, and which receive a plurality of laterally spaced vertical studs each having inner surfaces which are flush with the inner surfaces of the vertical support members for attaching wall sheathing. A basement floor support channel is mounted across the inner surfaces of the vertical support members for receiving the ends of a plurality of laterally spaced floor stringers for forming a basement floor structure. An upper floor support channel is mounted across the upper surface of the upper beam for receiving the ends of a plurality of laterally spaced first floor stringers. These channels and stringers may be made of metal or other suitable material.

33 Claims, 5 Drawing Sheets

FABRICATED FOUNDATION WALL

TECHNICAL FIELD

This invention is directed to a fabricated foundation wall and more particularly to a foundation wall formed as a basement wall grid from structural members, such as steel tubular members and I-beams.

BACKGROUND ART

Typically, foundation or basement walls are constructed of reinforced concrete poured between spaced forms. Although such basement wall structures have been satisfactory for their intended purpose, they have several drawbacks. A considerable amount of time is required to erect the forms. After erection, reinforcing material must be positioned in the forms. Next, the concrete is poured into the forms. Several days are required for curing of the concrete before significant building activity can proceed above the concrete foundation and before backfilling can occur. The dimensions of such a concrete basement wall are less precise than desired, making accurate dimensioning of the building above more difficult. Construction of concrete basement walls is labor intensive and therefore costly. Finally, over time concrete walls crack due to settling and the movement of expansive earth about them, making them subject to water leaks.

Walls constructed of vertical and horizontal steel members are well known, as disclosed in U.S. Pat. No. 4,462,193 to Ericson and U.S. Pat. No. 5,287,675 to McGee. Although these structures are suitable for their intended purpose, neither is intended for the construction of basement walls.

DISCLOSURE OF THE INVENTION

In accordance with this invention a fabricated foundation wall for a building is provided which is constructed in the soil below grade level and includes three components. The first component is a basement wall grid. The basement wall grid has a horizontal lower beam mounted on spaced piers. A plurality of vertical support members are spaced laterally along and extend upwardly from the lower beam. An upper horizontal beam of substantially identical configuration to the lower beam, spans the vertical support members and is attached thereto. The second component is an exterior wall structure which attaches to and extends across the outer surface of the basement wall grid and extends below the lower horizontal beam to form an air void after soil is backfilled against the fabricated foundation wall so that the lower beam does not contact the soil below it. The third component is an interior wall structure which includes lower and upper tracks attached to the lower and upper beams, respectively, which receive a plurality of laterally spaced vertical studs each having a side wall which is flush with the inner surface of the I-beams. This inner wall structure can be finished on the inside by attaching wall sheathing (not shown) and providing insulation (not shown) between the studs.

In addition to the basement wall grid, the exterior wall structure and the interior wall structure, a basement floor support and a first or main floor support mounted on the fabricated foundation wall is also contemplated. A basement floor support channel is mounted across the inner surface of the vertical support members for receiving the ends of a plurality of laterally spaced stringers for forming a basement floor structure. In one embodiment, an inwardly facing, upper floor support channel is mounted on the upper surface of the upper beam, flush with the outer surface of the basement wall grid, for receiving the ends of a plurality of laterally spaced stringers which may be in the form of channels. These stringers are made of metal, such as steel, or other suitable material. In an alternative embodiment, a wooden first floor structure is attached to the basement wall grid by providing a 2×4 board which lays flat and extends along the upper surface of the upper tubular beam flush with the outer surface of the basement wall grid. A 2×10 or 2×12 board is set on edge on the upper surface of the 2×4 board so that the outer side is flush with the outer surface of the basement wall grid. A plurality of laterally spaced wooden I-beams each have an end resting on the 2×4 board and abutting the inner side of the 2×10 or 2×12 board to form an upper floor structure.

Counterforts can be provided which are constructed out of the same material as the basement wall grid.

It is contemplated that for most applications all three components of the fabricated foundation wall of this invention will be used together. However, for some applications it may be desirable to use the basement wall grid and exterior wall structure, with or without an upper floor support, with a different interior wall structure. For other applications, it may be desirable to use the basement wall grid and the interior wall structure with or without the basement floor and/or upper floor support, with a different exterior wall structure. In one embodiment of this invention the basement wall grid and the interior wall structure share common components in order to provide a simplified and less expensive fabricated foundation wall. Each of these combinations of elements is contemplated to be within the scope of this invention.

From the description which follows, taken together with the accompanying drawings, the advantages of this invention will be readily apparent.

BEST MODE FOR CARRYING OUT THE INVENTION

Figure 1:
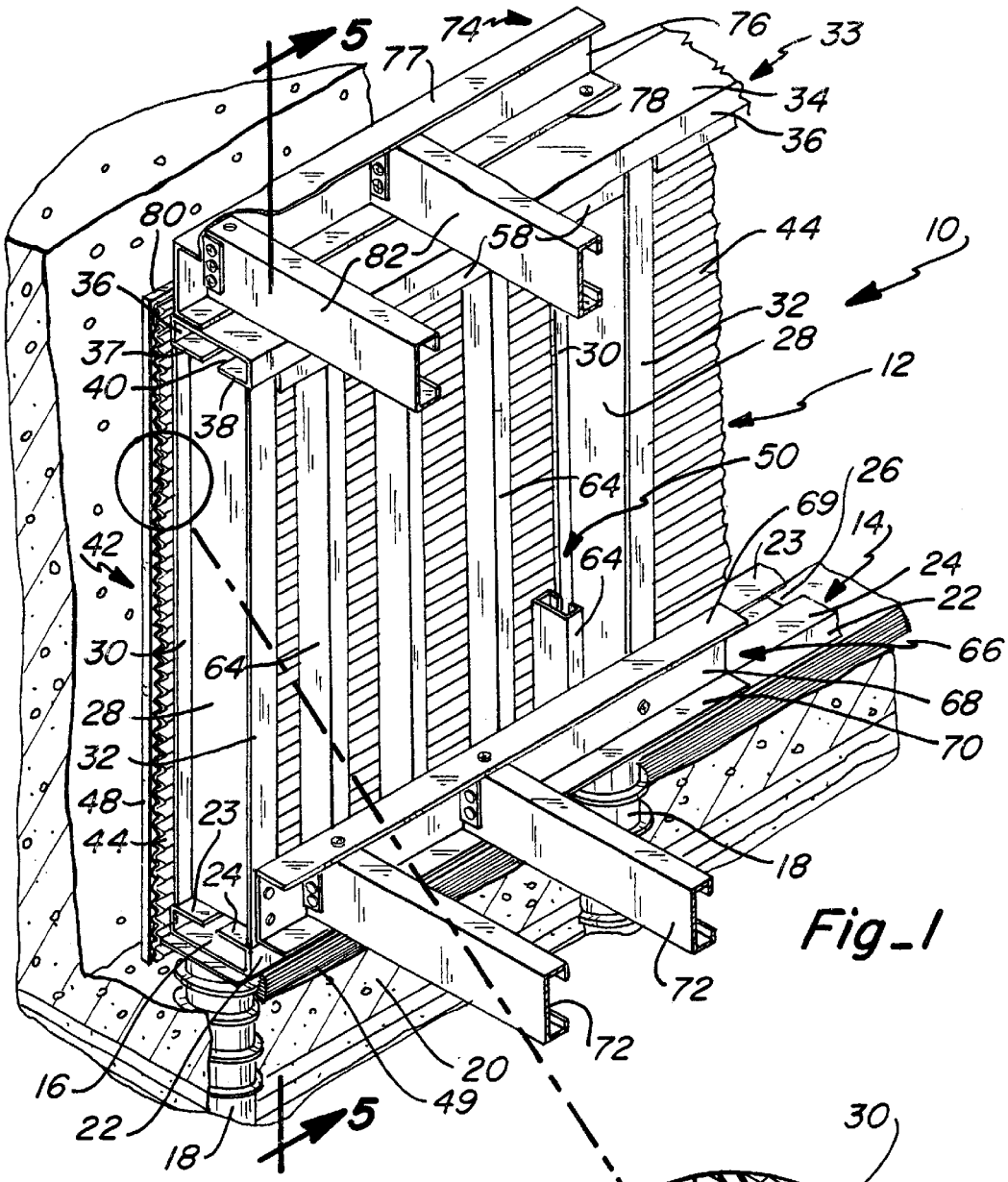
FIG. 1 is a fragmentary perspective view of the fabricated foundation wall of this invention.
Figure 2:
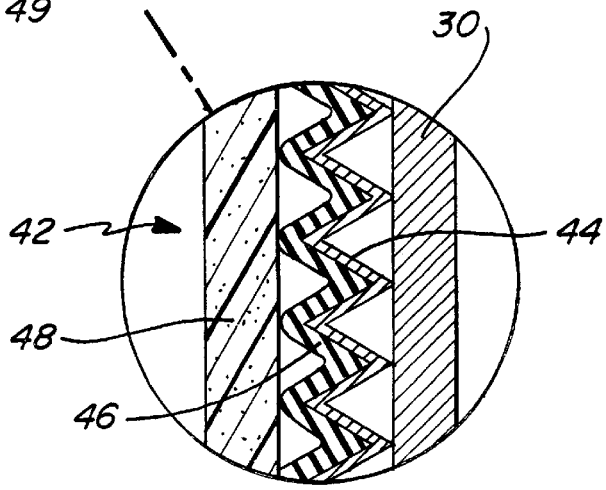
FIG. 2 is an enlarged, fragmentary cross section of the outer wall construction.

In accordance with this invention, a fabricated foundation wall 10 is provided, as best shown in FIG. 1. Steel is the material of choice for the structural members which comprise foundation wall 10. However, it will be understood that other materials are contemplated, such as other metals, plastics and composite materials which may be extruded or molded.

Fabricated foundation wall 10 comprises three major components. The first is a basement wall grid 12 which includes a lower beam, laterally spaced vertical support members extending upwardly from the lower beam and an upper beam spanning and connected to upper ends of the vertical support members. Specifically, a lower, horizontal, tubular, C-shaped beam 14, preferably made from ¼" steel, has a bottom surface 16 defining the width of beam 14, typically 10", which is supported by spaced footings, such as helical piers 18 positioned in ground 20 below. Other types of piers or caissons can be used for footings as building and soil conditions warrant. Bottom surface 16 has upturned side edges 22 of a height which is less than the width of surface 16, typically 4", and which each terminate in opposed outer and inner inturned flanges 23 and 24, respectively, typically 4", forming a slot 26 therebetween. A plurality of vertical support members or purlins, such as I-beams 28, are laterally spaced along lower beam 14 with their lower ends attached within inturned flanges 24. I-beams 28 have a depth which is substantially equal to the width of beam 14. Outer flange 30 of I-beam 28 forms the outer surface of basement wall grid 12 and an inner flange 32 forms the inner surface of basement wall grid 12. An upper, horizontal, tubular, steel beam 33 completes the basement wall grid 12 which is identical to lower beam 14 but is inverted. Upper beam 33 spans the upper ends of I-beams 28 and includes an upper surface 34, depending edges 36 and inturned outer and inner flanges 37 and 38, respectively, which form a slot 40 therebetween. The 10" thickness of basement wall grid 12 allows for either a 4" or 6" interior wall and for a brick ledge.

Figure 3:
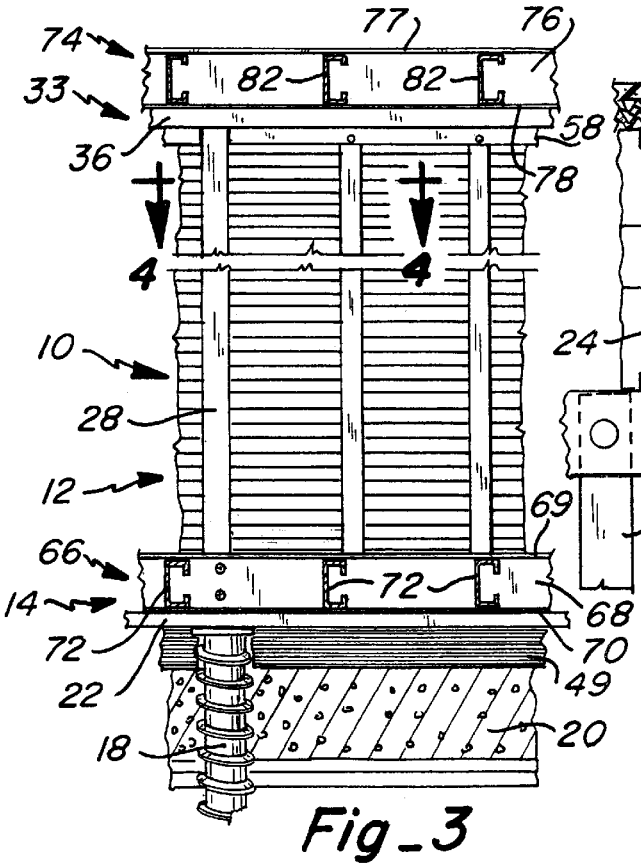
FIG. 3 front elevational view of the fabricated foundation wall of FIG. 1, on a reduced scale.
Figure 4:
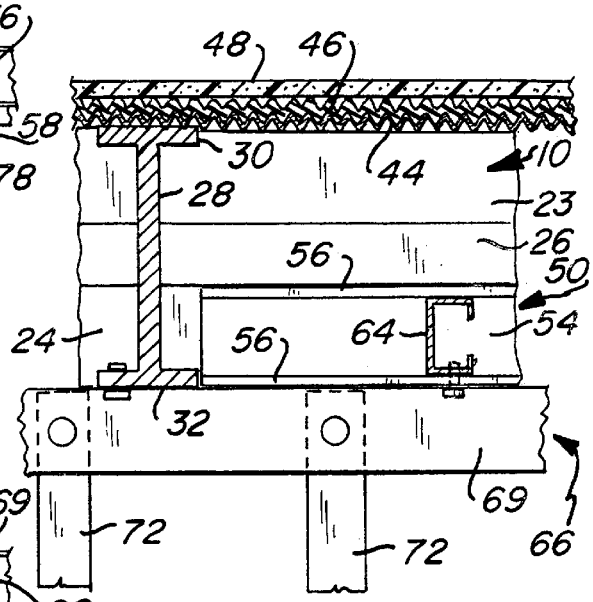
FIG. 4 is an enlarged horizontal section, taken along line 4—4 of FIG. 3 showing additional details of the fabricated foundation wall.

The second component of fabricated foundation wall 10 is outer wall structure 42 which is attached to the surface of outer flanges 30 of I-beams 28, as best seen in FIGS. 1, 2, 4 and 5. Wall structure 42 includes, in order, corrugated steel sheeting 44 attached to outer flanges 30 of I-beam 28, a layer of waterproof sheathing 46 contiguous with and bonded to the outside surface of corrugated sheeting 44 and a layer of insulation board 48 extending across and attached to corrugated steel sheeting 44 over waterproof sheathing 46. Any type of waterproofing material which provides a water and gas vapor barrier is suitable. A particular suitable material which can be sprayed onto corrugated sheeting 44 is Liquid Boot® manufactured by LBI Technologies, Inc. of Anaheim, Calif. Insulation board 48 can be made of any conventional foam material or other well known insulation material suitable for the exterior of a building and will typically be 1½" thick. Other well known insulation materials can be used, such as foil covered insulation material. Advantageously, the lower end of outer wall structure 42 extends below the bottom of lower beam 22 to form an air void so that when dirt is backfilled against outer wall structure 42 it will not fill in the space under lower beam 14. If desired, a filler material 49 can be placed in this space, as shown in FIGS. 1 and 3, to assure that no dirt contact lower beam 14. This void assures that lower beam 22 will not rest directly on the ground 20 so that any settling or expansion of the soil will not cause the fabricated foundation wall to move.

The third component of the fabricated foundation wall 10 is inner wall structure 50, best seen in FIGS. 3–7, includes a lower track 52 having a base 54 with upturned edges 56, attached to inner flange 24 of lower beam 14. Track 52 has a width substantially the same as that of inner flange 24 An upper track 58, having base 60 with downturned edges 62, is attached to inner flange 38 of upper beam 33 and has a width substantially the same as that of inner flange 38. A plurality of laterally spaced, C-shaped, metal studs 64 have their lower ends mounted in and attached to lower track 52 and their upper ends mounted in and attached to upper track 58. Studs 64 each have an inner surface which is substantially flush with the inner surface of inner surface 32 of I-beam 28. The thickness of inner flanges 56 and 62 of channels 52 and 58, respectively, prevent the inner surfaces of studs 64 and inner surfaces 32 of I-beams 28 from being perfectly flush. This difference is insignificant in most applications. This inner wall structure 50 is used for attachment of interior wall sheathing (not shown). Conveniently, metal studs 64 may be formed as either 2×4s or 2×6s, depending on the thickness desired for the wall. The width of lower and upper tracks 52 and 58 can be selected accordingly. Typically, studs 64 are made of 25 gauge steel and are spaced 16" on center. However, other steel thicknesses and spacing can be used.

A basement floor support channel 66 can be mounted laterally across and has a vertical web or base 68 attached to the inner flanges 32 of I-beams 28, adjacent the lower ends thereof, with inwardly facing upper and lower side edges 69 and 70, respectively. The ends of laterally spaced basement floor stringers 72 have ends which are attached within channel 66 and rest on lower side edge 70. A floor (not shown) can be constructed over stringers 72 in a conventional manner. Since this floor is suspended above the surface of the ground 20, it not subject to the forces of expansive soil. Therefore, the possibility of the basement floor cracking or bulging is greatly minimized.

A first or upper floor support, such as support channel 74, can be provided as shown in FIGS. 1 and 3. Support channel 74 has a vertical web or base 76 with inturned upper and lower flanges 77 and 78, respectively. Lower side edge 78 rests on the upper surface 34 of upper beam 33 and is positioned so that the outside surface of base 76 is flush with outside depending edge 36 of upper beam 33. This arrangement exposes the upper edge 80 (FIGS. 1 and 5) of outer wall structure 42 to provide a ledge for supporting the exterior wall of the building to be built thereabove. Laterally spaced upper floor stringers 82 are received within first floor channel 74 upon which a conventional steel floor (not shown) can be constructed.

Figure 6:
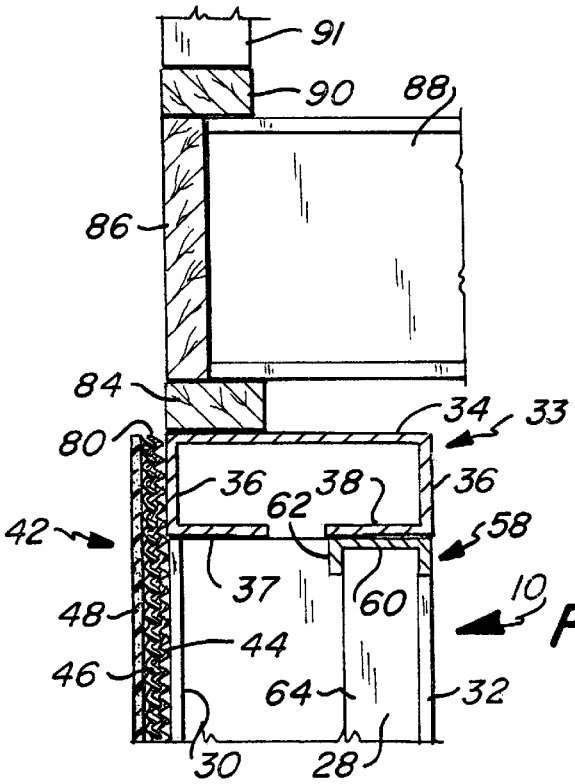
FIG. 6 is an enlarged fragmentary vertical section showing the fabricated foundation wall used with an alternative wooden first floor construction.

An alternative first floor support for a conventional wooden floor (not shown) is illustrated in FIG. 6. A 2×4 first board 84 replaces first floor support channel 74. As shown, it lays flat on the upper surface 34 of upper beam 33 with its outer edge aligned with be outer surface of outer depending edge 36. As in the previous embodiment, the upper edge 80 of outer wall structure 42 is exposed for supporting the exterior wall of the building. A 2×10 or 2×12 second board 86 is placed on edge on top of the 2×4 first board 84. A plurality of laterally spaced wooden stringers, such as I-beam 88, each have an end sitting on the 2×4 first board 84 and abutting the 2×10/2×12 second board 86. A 2×4 or 2×6 third board 90 can be placed on top of second board 86 and I-beam 88, as shown, on which a wall 91 of the building can be constructed. Conveniently, 2×4 first board 84, 2×10/2×12 second board 86 and 2×4/2×6 third board 90 form a channel for receiving the ends of I-beams 88. A conventional wooden floor structure (not shown) can be built on the wooden stringers.

Figure 7:
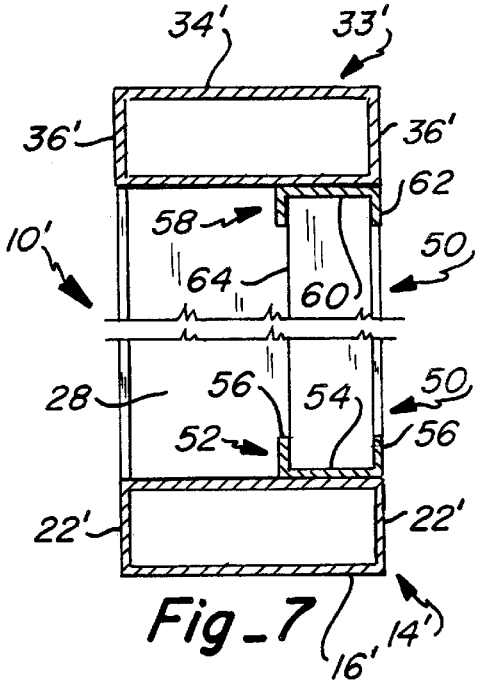
FIG. 7 is a fragmentary vertical section, on a reduced scale, showing an alternative form of upper and lower beams.

An alternative construction for the basement wall grid 12 is shown in FIG. 7 wherein lower beam 14' and upper beam 33' are closed tubes instead of C-shaped tubes. It should be understood that the terms "tube" and "tubular" as used herein include both the C-shape of lower beam 14 and upper beam 33 of FIGS. 1–6 and the closed tubes of lower beam 14' and upper beam 33' of FIG. 7, as well as any other structural members that have either a C-shaped cross section or are a closed tube in cross section. Furthermore, although the vertical support members or purlins have been illustrated as I-beams, they could be of some other configuration including but not limited to round, square or rectangular posts.

Figure 5:
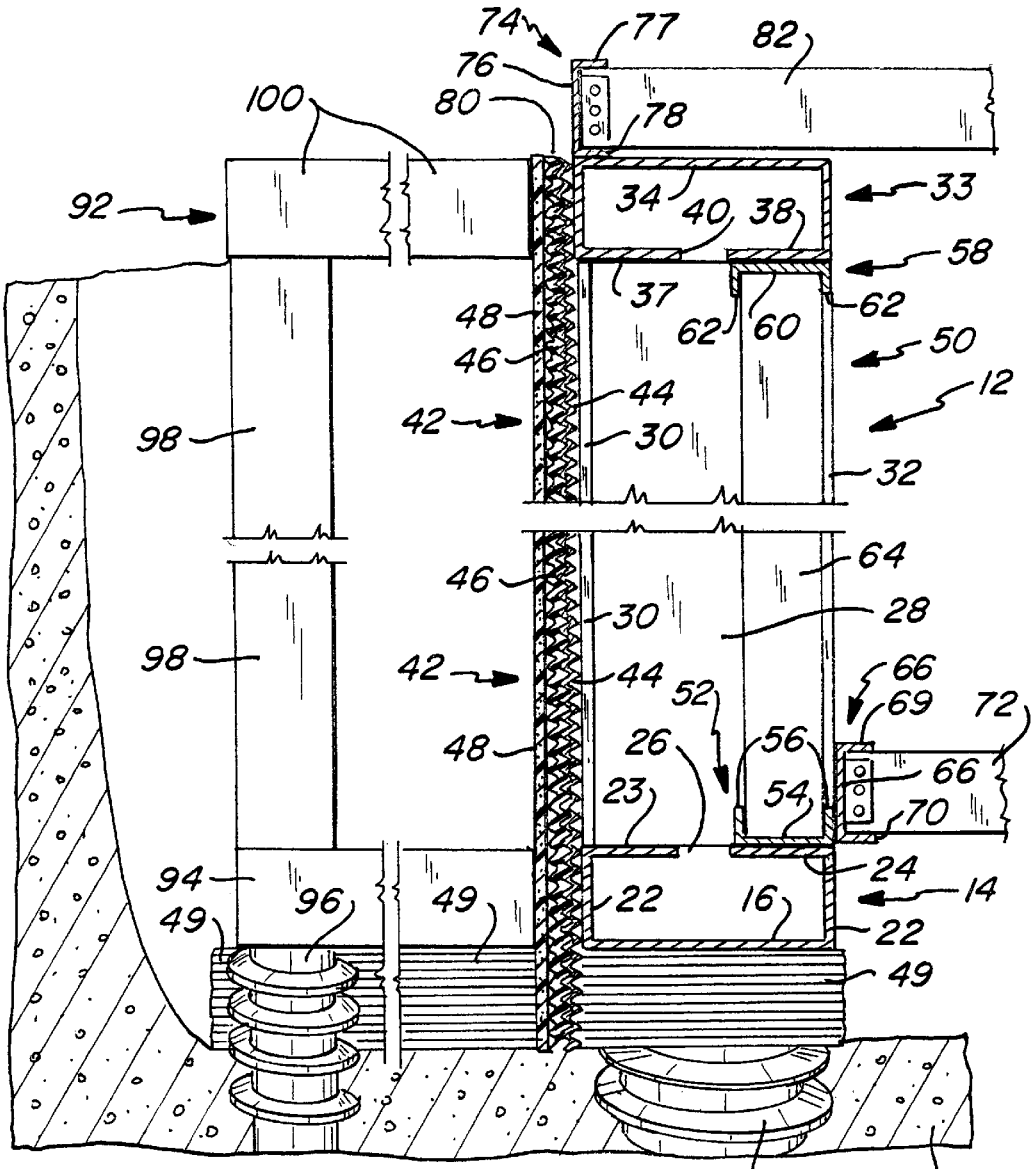
FIG. 5 is an enlarged vertical section, taken along line 5—5 of FIG. 1 showing additional details of the fabricated foundation wall and showing a counterfort construction.
Figure 8:
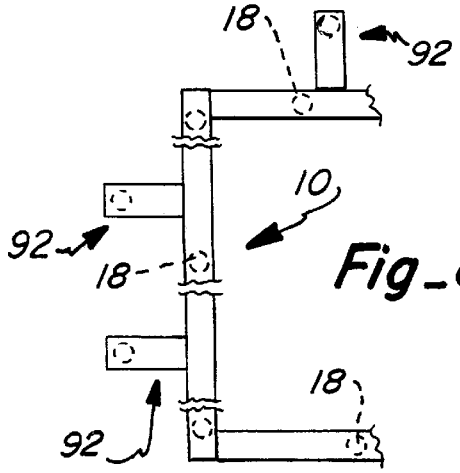
FIG. 8 is a small fragmentary plan view of the fabricated foundation wall showing the positioning of the counterforts.

Counterforts 92, shown in FIG. 5 can be provided along foundation wall 10, as required and as shown in FIG. 8. Each counterfort includes a lower beam 94 which has a proximate end attached to the outside of a lower beam 14 and a distal end supported by a counterfort pier 96. A vertical leg 98 extending upwardly from the distal end of lower beam 94 and connected to an upper beam 100 extending from and connected to the outside of a upper beam 33. The beams of the counterforts 92 conveniently may be constructed of tubular steel material similar to the beams, purlins and stringers shown for either the embodiment of FIGS. 1–6 or the embodiment of FIG. 7. Void material 49 also is provided under the lower beam 94 of counterforts 92 so that the counterforts do not rest directly upon ground 20.

Figure 9:
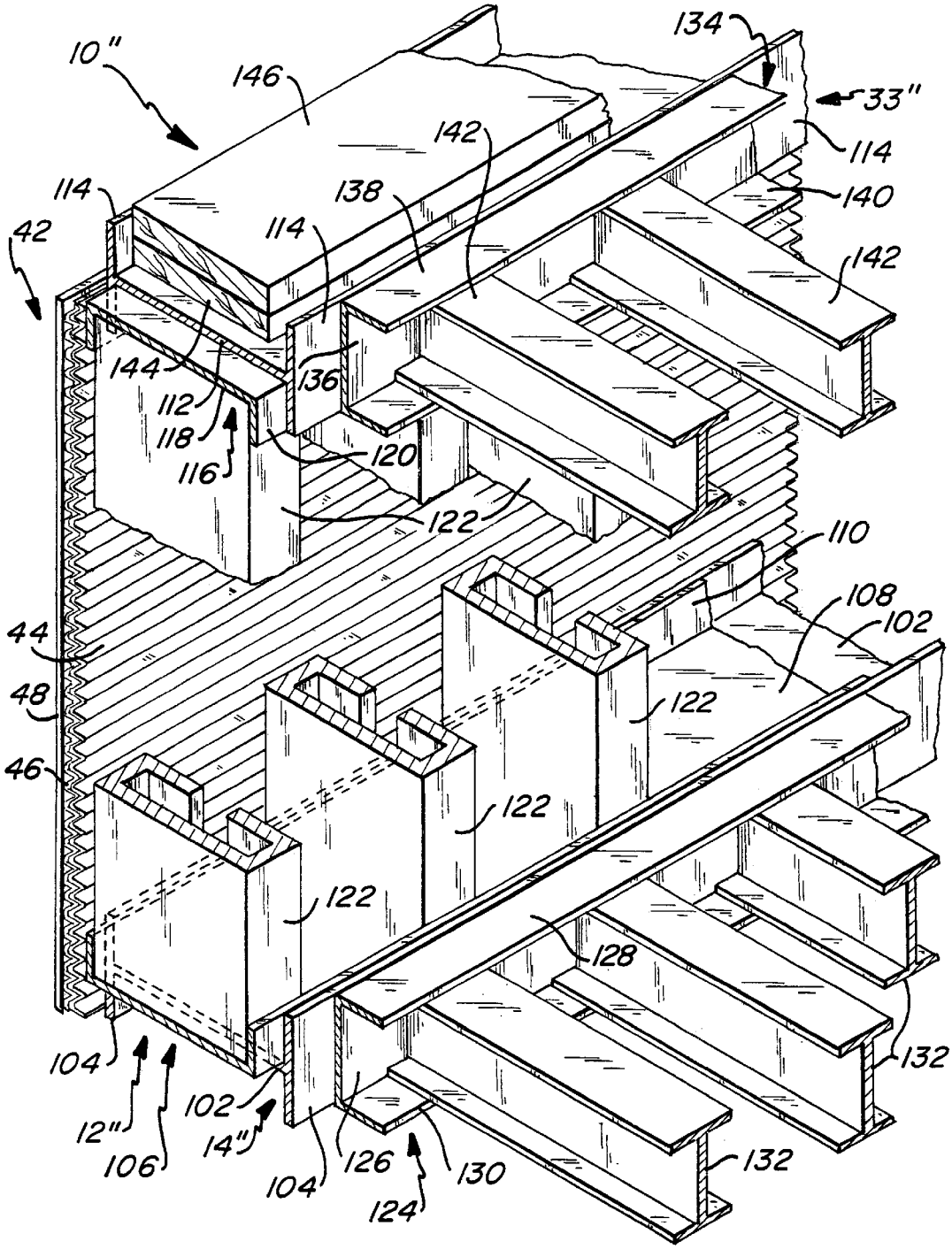
FIG. 9 is a fragmentary perspective view of a further embodiment of this invention.

In another embodiment of the invention, shown in FIG. 9 a fabricated foundation wall 10" comprising a basement wall grid 12" which includes a lower horizontal I-beam 14" and an upper I-beam 33". Lower beam 12" is supported on spaced piers (not shown), which are similar to piers 18 of FIG. 1. Lower beam 12" has a horizontally extending web 102 and spaced vertical outside and inside flanges 104. A lower channel 106 has a base 108 which rests on the upper surface of web 102 and has upturned edges 110 which are adjacent the upturned outside and inside portions of flanges 104, respectively. Similarly, upper beam 33" has a horizontally extending web 112 and spaced vertical outside and inside flanges 114. An upper channel 116 has a base 118 which engages the lower surface of web 112 and has downturned edges 120 which are adjacent downturned outside and inside portions of flanges 114, respectively. Upright, laterally spaced, vertical support members 122 have lower ends attached to and within lower channel 106 and have upper ends which are attached to and within upper channel 116. These channels may be made of a heavy gauge steel, such as 14 gauge or larger. By use of these heavier support members 122 as studs, the vertical I-beams 28 of FIG. 1 are not required. These support members 122 can be C-shaped, as shown, or closed tubes. With this construction, the basement wall grid and the inner wall structure become a single composite structure.

Conveniently, a basement floor channel 124 has a base 126 attached to inside flange 104. Channel 124 has an inwardly projecting upper inturned side edge 128 and a lower inturned side edge 130 which supports laterally spaced basement floor stringers 132. A first or upper floor channel 134 has a base 136 attached to inside vertical flange 114. Upper floor channel 134 has an inturned upper side edge 138 and an inturned lower side edge 140 supporting laterally spaced first floor stringers 142. Outer wall structure 42 is attached to the outer surfaces of vertical support members 122. A pair of boards, such as boards 144 and 146 are stacked on web 112 of upper beam 33" to form a plate upon which a first floor building wall (not shown) can be built. The size of these boards is preferably 2×10 or 2×12 but can be any other suitable size which meets the structural requirements of the building.

Figure 11:
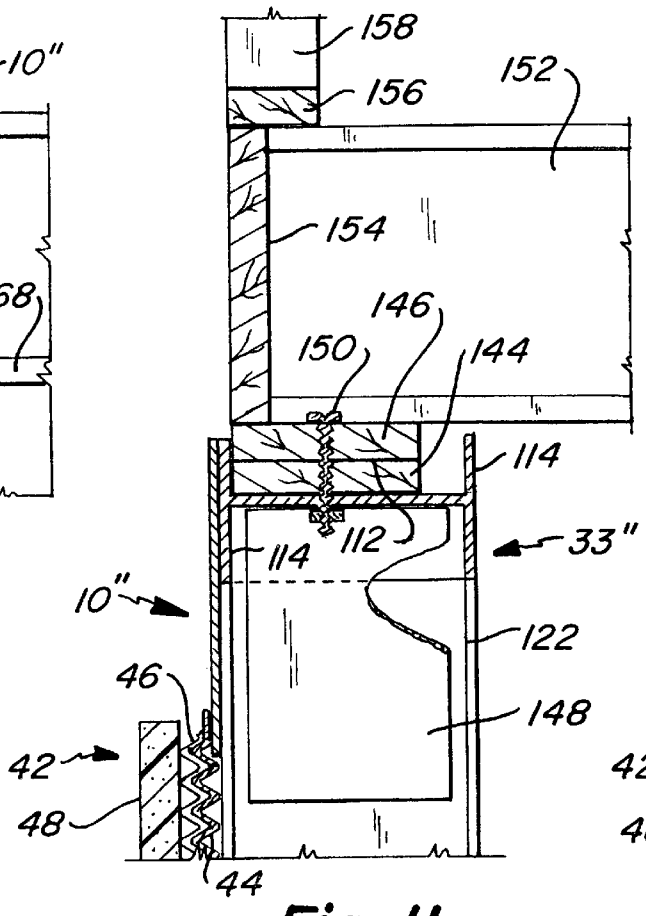
FIG. 11 is an enlarged horizontal section, taken along line 11—11 of FIG. 10.
Figure 10:
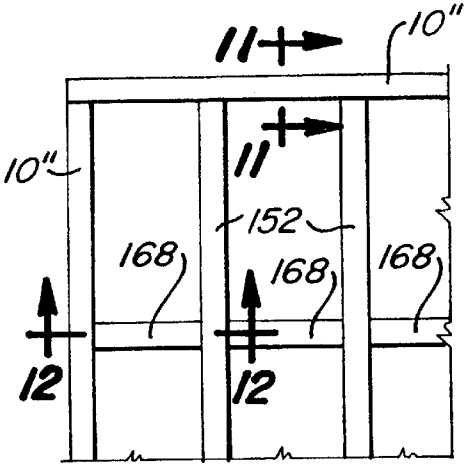
FIG. 10 is a fragmentary, top plan view of a corner of another fabricated foundation wall of this invention, shown on a greatly reduced scale.

FIG. 11 shows an alternative construction along one fabricated foundation wall 10" of FIG. 10 wherein the upper end of vertical support member 122 abuts the downwardly extending portion of inside and outside flanges 114 of upper beam 33" and is connected to web 112 by means of a plate 148, as by welding. Boards 144 and 146 are attached to web 112, as by spaced screws, such as screw 150. A plurality of laterally spaced wooden stringers, such as stringer 152 each have an end supported on board 146 and faced with vertical board 154. A 2×4 or 2×6 board 156 is placed flat on top of the upper edge of vertical board 154 and the top of stringer 152 which supports a first floor wall 158. Conveniently, board 146, board 154 and board 156 form a channel for receiving the ends of stringers 152.

Figure 12:
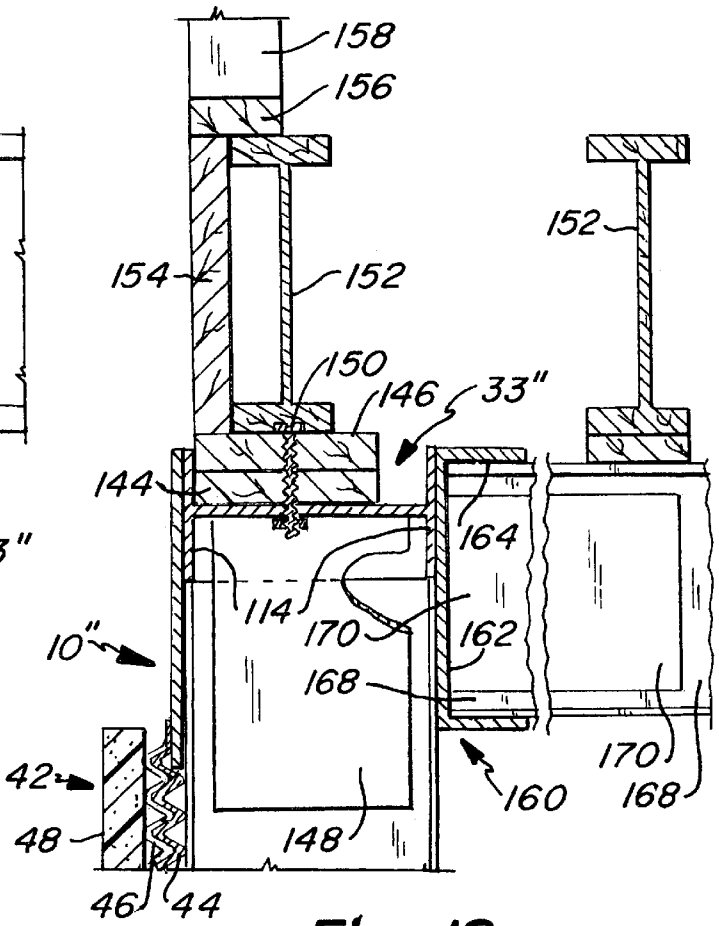
FIG. 12 is an enlarged horizontal section, taken along line 12—12 of FIG. 10.

FIG. 12 shows the construction of the fabricated foundation wall 10" which is at right angles to wall 10" in FIG. 11, as shown by the section lines of FIG. 10. Conveniently, a first floor channel 160 has a base 162 attached to and depending from inside flange 114 of upper beam 33", as shown. Channel 160 has an inturned upper edge 164 and an inturned lower edge 166 which supports first floor support beam 168 which is attached to channel 160 by plate 170 attached thereto, as by welding. Support beam 168 can be supported by intermediate posts (not shown) depending upon the span across which support beam 168 extends.

The various structural elements of this invention may be interconnected by welding, bolts, screws, brackets, plates, any combination of these or by any other suitable means.

From the foregoing, the advantages of this invention are readily apparent. A fabricated basement wall construction has been provided which can be made to much more precise dimensions than is possible with concrete. This provides a more level and precise surface on which to begin framing a building structure. Construction time to build a steel foundation which is ready for backfill in approximately three days as opposed to the conventional twelve to fourteen days required for a concrete foundation. Because of the labor saving, the steel foundation is less expensive to build than a concrete foundation. Engineering of proper loads for each pier is more accurate and there is less chance for engineering errors to occur in the field.

Additionally, there is less chance for the steel foundation walls of this invention to bow during backfill than with concrete walls. This steel foundation wall construction is less subject to cracks and water leaks. The interior finish will be more cost effective and provide increased square footage within the basement because there is no need to frame an additional wall on the interior of the foundation wall.

This invention has been described in detail with reference to particular embodiments thereof, but it will be understood that various other modifications can be effected within the spirit and scope of this invention.

What is claimed is:

1. A fabricated foundation wall constructed in soil at an excavated level which is below grade level, said fabricated foundation wall comprising:

laterally spaced and aligned footings positioned in the soil below the excavated level;

a horizontal lower beam, having a bottom surface of a first width mounted on said footings and having an upper surface;

a plurality of laterally spaced vertical support members each having a first lower end attached to said upper surface of said lower beam and each of said support members having an upper end and an inner surface;

a horizontal upper beam spanning said vertical support members and having a lower surface attached to said upper end of each of said vertical support members, and said upper beam further having an upper surface, said lower and upper beams and said vertical support members forming a basement wall grid having an outer surface and an inner surface; and an outer wall structure attached to and extending laterally across said outer surface of said basement wall grid and extending below said lower beam to form a first air void between the excavation level of the soil and said bottom surface of said lower beam after soil is backfilled against said fabricated foundation wall.

2. A fabricated foundation wall, as claimed in claim 1, wherein said outer wall structure includes, in order from inside to outside:

corrugated sheeting attached to and extending across said outer surface of said basement wall grid;

a layer of waterproof sheathing bonded to said corrugated sheeting; and an insulation layer attached to said corrugated sheeting over said waterproof sheathing.

3. A fabricated foundation wall, as claimed in claim 1, further including an interior wall structure comprising:

a lower track having a base attached to said upper surface of said lower beam and having opposite upwardly extending side edges;

an upper track having a base attached to said lower surface of said upper beam and having opposite downwardly extending side edges; and a plurality of vertical studs each having upper ends mounted in said upper track and lower ends mounted in said lower track.

4. A fabricated foundation wall, as claimed in claim 3, wherein:

each of said vertical studs have an inner surface which is substantially flush with the inner surface of said vertical support members.

5. A fabricated foundation wall, as claimed in claim 3, further including:

a basement floor support channel having a web mounted laterally across said inner surfaces of said vertical support members adjacent said lower ends thereof, and further having opposite inwardly facing side edges.

6. A fabricated foundation wall, as claimed in claim 5, further including:

a plurality of laterally spaced stringers, each having a first end connected within said side edges of said basement floor support channel.

7. A fabricated foundation wall, as claimed in claim 3, further including:

an upper floor support channel mounted on said upper beam and having opposite inwardly facing side edges.

8. A fabricated foundation wall, as claimed in claim 7, further including:

a plurality of laterally spaced stringers, each having a first end connected within said side edges of said upper floor support channel.

9. A fabricated foundation wall, as claimed in claim 3, further including:

a first board mounted on said upper surface of said upper beam and flush with said outer surface of said basement wall grid, and having an upper surface;

a second board mounted on said upper surface of said first board and having an outer side flush with said outer surface of said basement wall grid, and further having an inner side;

a plurality of laterally spaced beams, each having a first end resting on said first board and abutting said inner side of said second board.

10. A fabricated foundation wall, as claimed in claim 1, wherein:

said vertical support members are I-beams.

11. A fabricated foundation wall, as claimed in claim 1, wherein:

said lower and upper beams are I-beams.

12. A fabricated foundation wall, as claimed in claim 1, further including:

a first void material positioned in the first air void between the excavation level and said bottom surface of said lower beam.

13. A fabricated foundation wall, as claimed in claim 1, further including:

a counterfort attached to and extending perpendicular from said outer surface of said wall grid.

14. A fabricated foundation wall, as claimed in claim 13, wherein said counterfort includes:

a counterfort footing positioned in the soil below the excavated level; and a lower counterfort beam having a first end attached to and extending perpendicularly to said lower beam and having a second end supported by said counterfort footing, said counterfort beam further having a bottom surface spaced above the excavation level to form a second air void.

15. A fabricated foundation wall, as claimed in claim 14, further including:

a second void material positioned in the second air void between the excavation level and said bottom surface of said lower counterfort beam.

16. A fabricated foundation wall, as claimed in claim 1, wherein:

said upper and lower beams are tubular.

17. A fabricated foundation wall, as claimed in claim 16, wherein:

said upper surface of said lower beam has opposed inturned flanges forming an upwardly facing slot; and said lower surface of said upper beam has oppose inturned flanges forming a downwardly facing slot.

18. A fabricated foundation wall, as claimed in claim 17, further including:

a lower track having a base attached to at least one of said inturned flanges of said lower beam adjacent said inner surface of said basement wall grid and having opposite upwardly extending side edges;

an upper track having a base attached to at least one of said inturned flanges of said upper beam adjacent said inner surface of said basement wall grid and having opposite downwardly extending side edges; and a plurality of vertical studs each having upper ends mounted in said upper track and lower ends mounted in said lower track, and further having inner surfaces which are substantially flush with the inner surface of said vertical support members.

19. A fabricated foundation wall constructed in soil below grade level, said fabricated foundation wall comprising:

laterally spaced and aligned footings positioned in the soil below the excavated level;

a horizontal lower beam, having a bottom surface of a first width mounted on said footings spaced piers, and having an upper surface;

a plurality of laterally spaced vertical support members each having a first lower end attached to said upper surface of said lower beam and each of said support members having an upper end and an inner surface;

a horizontal upper beam spanning said vertical support members and having a lower surface attached to said upper end of each of said vertical support members, and said upper beam further having an upper surface, said lower and upper beams and said vertical support members forming a basement wall grid having an outer surface and an inner surface;

a lower track having a base attached to said upper surface of said lower beam and having opposite upwardly extending side edges;

an upper track having a base attached to said lower surface of said upper beam and having opposite downwardly extending side edges; and a plurality of vertical studs each having upper ends mounted in said upper track and lower ends mounted in said lower track and further having inner surfaces which are substantially flush with the inner surface of said vertical support members.

20. A fabricated foundation wall, as claimed in claim 19, further including:

a basement floor support channel having a web mounted laterally across said inner surfaces of said vertical support members adjacent said lower ends thereof, and further having opposite inwardly facing side edges.

21. A fabricated foundation wall, as claimed in claim 20, further including:

a plurality of laterally spaced stringers, each having a first end connected within said side edges of said basement floor support channel for forming a basement floor structure.

22. A fabricated foundation wall, as claimed in claim 19, further including:

an upper floor support channel mounted on said upper beam and having opposite inwardly facing side edges.

23. A fabricated foundation wall, as claimed in claim 22, further including:

a plurality of laterally spaced stringers, each having a first end connected within said side edges of said upper floor support channel.

24. A fabricated foundation wall, as claimed in claim 19, further including:

a first board mounted on said upper surface of said upper beam and flush with said outer surface of said basement wall grid, and having an upper surface;

a second board mounted on said upper surface of said first board and having an outer side flush with said outer surface of said basement wall grid, and further having an inner side;

a plurality of laterally spaced beams, each having a first end resting on said first board and abutting said inner side of said second board.

25. A fabricated foundation wall, as claimed in claim 19, wherein:

said vertical support members are I-beams.

26. A fabricated foundation wall, as claimed in claim 19, wherein:

said lower and upper beams are I-beams.

27. A fabricated foundation wall, as claimed in claim 19, wherein:

said upper and lower beams are tubular.

28. A fabricated foundation wall, as claimed in claim 27, wherein:

said upper surface of said lower beam has opposed inturned edges forming an upwardly facing slot; and said lower surface of said upper beam has oppose inturned edges forming a downwardly facing slot.

29. A fabricated foundation wall, as claimed in claim 28, further including:

a lower track having a base attached to at least one of said inturned flanges of said lower beam adjacent said inner surface of said basement wall grid and having opposite upwardly extending side edges; and an upper track having a base attached to at least one of said inturned flanges of said upper beam adjacent said inner surface of said basement wall grid and having opposite downwardly extending side edges.

30. A fabricated foundation wall constructed in soil below grade level, said fabricated foundation wall comprising:

laterally spaced and aligned footings positioned in the soil below the excavated level;

a horizontal lower beam, having a bottom surface of a first width mounted on said footings spaced piers, and having an upper surface;

a horizontal upper beam having a lower surface and an upper surface;

a lower track having a base attached to said upper surface of said lower beam and having opposite upwardly extending side edges;

an upper track having a base attached to said lower surface of said upper beam and having opposite downwardly extending side edges; and a plurality of laterally spaced vertical support members each having a first lower end mounted in said lower track and each having an upper end mounted in said upper track.

31. A fabricated foundation wall, as claimed in claim 30, wherein:

said upper and lower beams are l-beams each having horizontal webs and spaced vertical flanges; and said vertical support members are tubular.

32. A fabricated foundation wall, as claimed in claim 31, wherein:

said vertical support members are C-shaped.

33. A fabricated foundation wall, as claimed in claim 31, wherein:

said web of said lower I-beam forms said upper surface;

said web of said upper I-beam forms said lower surface;

said base of said lower track rests upon said web of said lower I-beam with said upwardly extending side edges of said lower track adjacent said flanges of said lower I-beam; and said base of said upper track engages said web of said upper I-beam with said downwardly extending side edges of said upper track adjacent said flanges of said upper I-beam.

* * * * *